US005566868A

United States Patent [19]

Mariscal et al.

[11] Patent Number: 5,566,868

[45] Date of Patent: Oct. 22, 1996

[54] BOOT PULLER

[76] Inventors: Jose Mariscal, 2703 Kenney Dr., San Pablo, Calif. 94806; Fernando Mariscal, 152 Ashbury Ave., El Cerrito, Calif. 94530

[21] Appl. No.: 516,959

[22] Filed: Aug. 18, 1995

[51] Int. Cl.[6] ..... A47G 25/80

[52] U.S. Cl. ..... 223/113; 223/111

[58] Field of Search ..... 223/111, 112, 223/113, 114, 115, 118, 119

[56] References Cited

U.S. PATENT DOCUMENTS

| | | | |
|---|---|---|---|
| 28,927 | 6/1860 | Wheeler | 223/113 |
| 196,857 | 11/1877 | Aufderheide | 223/119 |
| 457,115 | 8/1891 | Gysin | 223/119 |
| 460,045 | 8/1891 | Tata | 223/114 |
| 562,050 | 6/1896 | Ulferts | 223/117 |
| 954,061 | 4/1910 | Von Taxis . | |
| 1,178,109 | 4/1916 | Stoubly | 223/117 |
| 2,903,170 | 9/1959 | Ahn | 223/111 |
| 3,380,634 | 4/1968 | Parish | 223/116 |
| 3,734,363 | 5/1973 | Teague, Jr. | 223/116 |
| 3,784,067 | 1/1974 | Hicks | 223/114 |
| 4,768,687 | 9/1988 | Ault | 223/116 |
| 5,050,784 | 9/1991 | Turner | 223/114 |
| 5,086,959 | 2/1992 | Jerry et al. | 223/114 |
| 5,088,959 | 2/1992 | Jerry et al. | 223/114 |
| 5,121,861 | 6/1992 | Wong | 223/114 |

FOREIGN PATENT DOCUMENTS

| | | | |
|---|---|---|---|
| 30480 | 5/1907 | Australia | 223/113 |
| 1265155 | 12/1961 | France | 223/114 |
| 225414 | 1/1910 | Germany | 223/114 |
| 563145 | 5/1974 | Switzerland | 223/113 |
| 534361 | 3/1941 | United Kingdom | 223/114 |

*Primary Examiner*—Bibhu Mohanty
*Attorney, Agent, or Firm*—Harris Zimmerman

[57] ABSTRACT

A device for facilitating removal of a boot from a foot by a standing person has an elongated shaft with a preferably right angled upper end that is grasped by the person and a pair of arms that extend out from the shaft. The arms are positioned to abut a rear portion of the boot at an elevated location and function to strip the boot from the foot as the foot is raised. The shaft has a lower end which extends below the location of the abutment of the arms and the boot in order to contact the underlying ground or floor during removal of a boot. The user leans on the shaft in order to maintain the device in a fixed position as the foot is being pulled out of the boot and in order to maintain balance while the foot is lifted.

11 Claims, 2 Drawing Sheets

Fig. 3
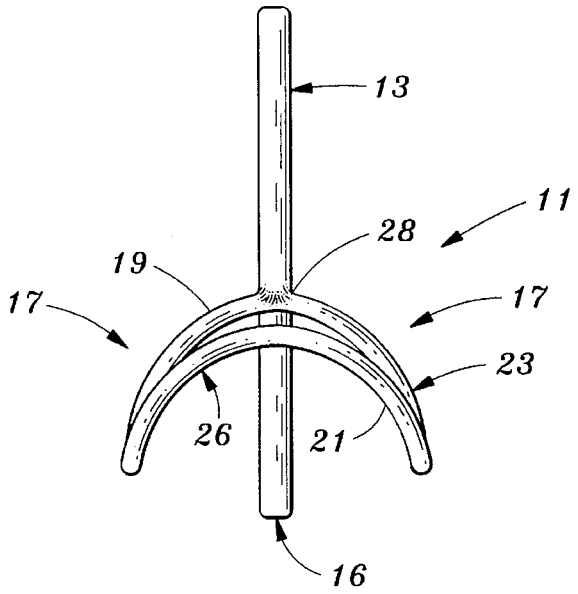
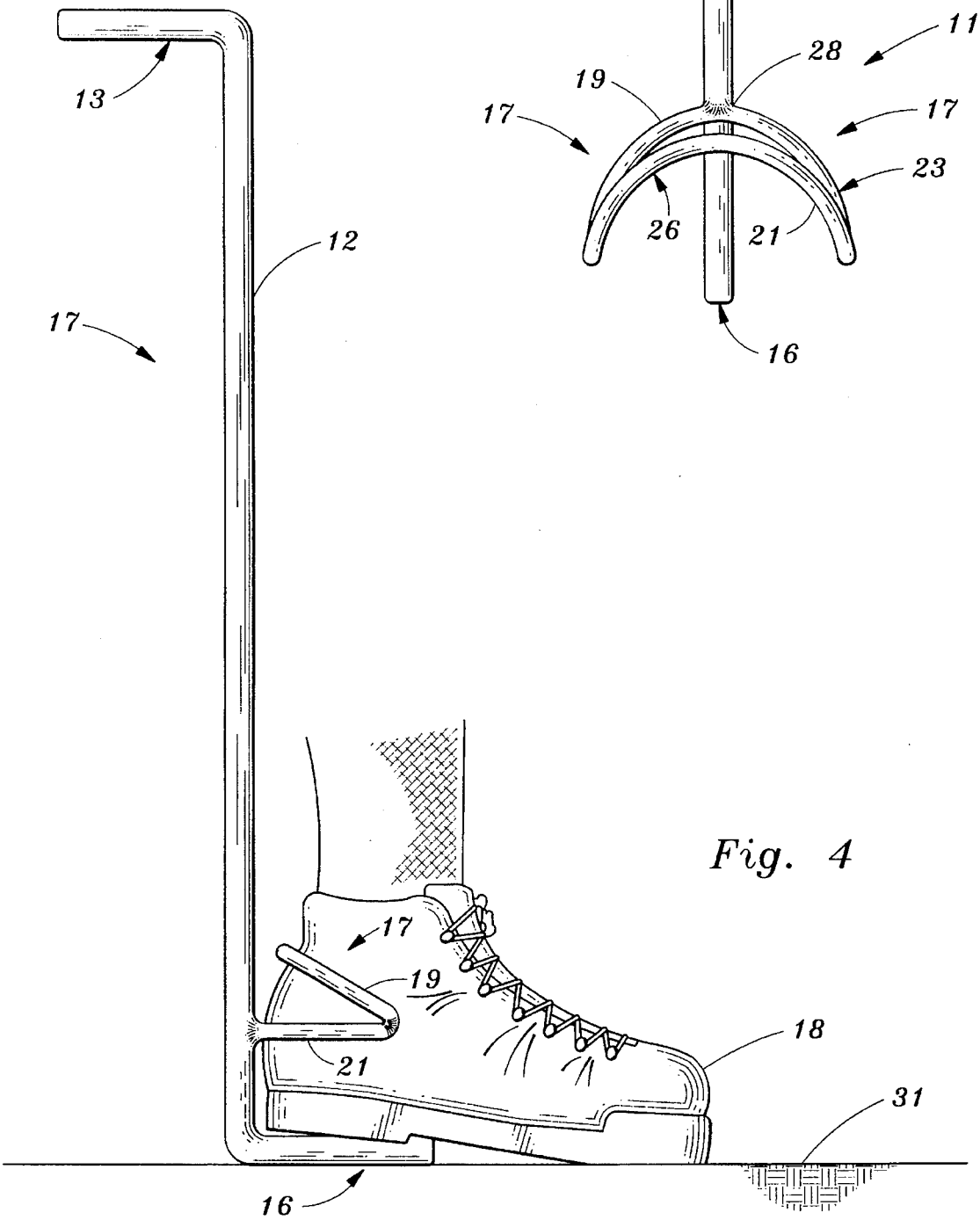
Fig. 4

BOOT PULLER

TECHNICAL FIELD

This invention relates to devices for facilitating removal of a boot or the like from a human foot and more particularly to devices of this kind which have a boot engaging component secured to a handle that is grasped by the user during removal of a boot or the like.

BACKGROUND OF THE INVENTION

Boots are a form of footwear that can be somewhat difficult to take off. Construction workers, hikers, farmers, hunters and others often wear boots in outdoor locations during adverse weather. This may result in an accumulation of mud on the boots which further complicates the process of removing the boots from one's feet.

Prior devices for facilitating removal of a boot from one's foot include devices which have a handle that is grasped by the user and which have a pair of fork like prongs at the end of the handle that are proportioned to bear against opposite sides of the rear part of the boot. The user can push boots off of his or her feet without touching the boots in the process.

Prior devices of the above discussed kind do not facilitate boot removal to the most desirable extent. The device must be carefully manipulated by the user to maintain it in an operative relationship with the boot as the boot is being pushed off of the foot. This user must accomplish this while balancing on one leg in instances where there is no convenient place to sit down. The devices are not particularly suited for picking up and carrying removed muddy boots without hand contact with the boots.

The present invention is directed to overcoming one or more of the problems discussed above.

SUMMARY OF THE INVENTION

In one aspect of the present invention, a device for facilitating removal of a boot from a human foot has an elongated shaft with an upper end that is adapted to be grasped by a person's hand and has a pair of boot abutting arms which extend outward from the shaft for abutment with a rear portion of a boot at a location thereon that is above the bottom of the boot. The arms are shaped to extend along opposite sides of the rear portion of the boot. The arms are configured to abut the boot at a location that is above the lower end of the shaft and the shaft extends below that location for a distance sufficient to enable contact of the lower end with the underlying ground while the arms abut the boot at that location In another aspect the invention provides a device for facilitating removal of a boot from a human foot which device includes an elongated shaft having an intermediate region and an upper end which extends substantially at right angles thereto. A lower end of the shaft extends in an opposite direction in right angled relationship with the intermediate region of the shaft. A pair of curved divergent arms extend outward from the intermediate region of the shaft at a location which is above the angled lower end of the shaft and spaced apart therefrom. The arms are located to extend along opposite sides of a rear portion of the boot and to be in abutment with the boot when the angled lower end of the shaft is situated beneath the rear portion of the boot.

The invention provides a boot remover of the hand held type which may contact the underlying ground or floor during removal of a boot. The device may be immobilized by leaning on the handle of the device thereby enabling removal of a boot from a foot simply by raising the foot. The device also makes it easier for the user to maintain balance while lifting one foot from the underlying surface during removal of a boot. The device may be inserted into a removed boot and be used to lift and carry the boot without hand contact therewith. The device can also be used to maintain a boot in an upright orientation while a standing person is inserting a foot into the boot.

The invention, together with further aspects and advantages thereof, may be further understood by reference to the following description of the preferred embodiment and by reference to the accompanying drawings.

BRIEF DESCRIPTION OF THE DRAWINGS

FIG. 3 is a top view of the boot puller of the preceding figures.

FIG. 4 is a side view depicting an initial stage in the use of the boot puller to remove a boot from a foot.

DETAILED DESCRIPTION OF THE PREFERRED EMBODIMENT

Figure 1:
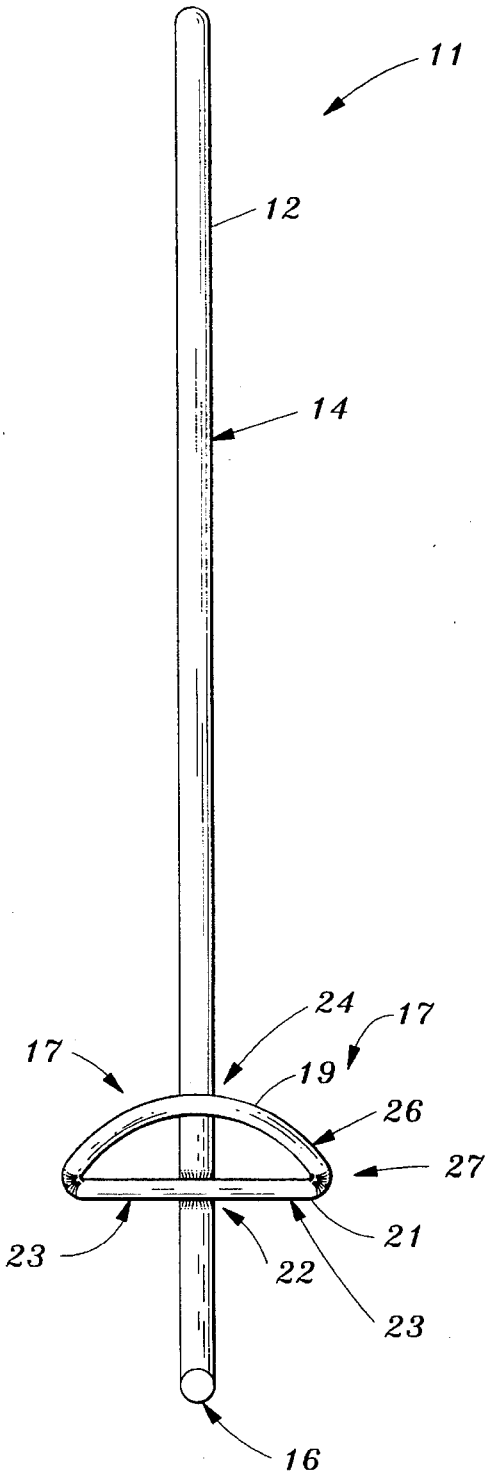
FIG. 1 is a front elevation view of a boot puller embodying the invention.
Figure 2:
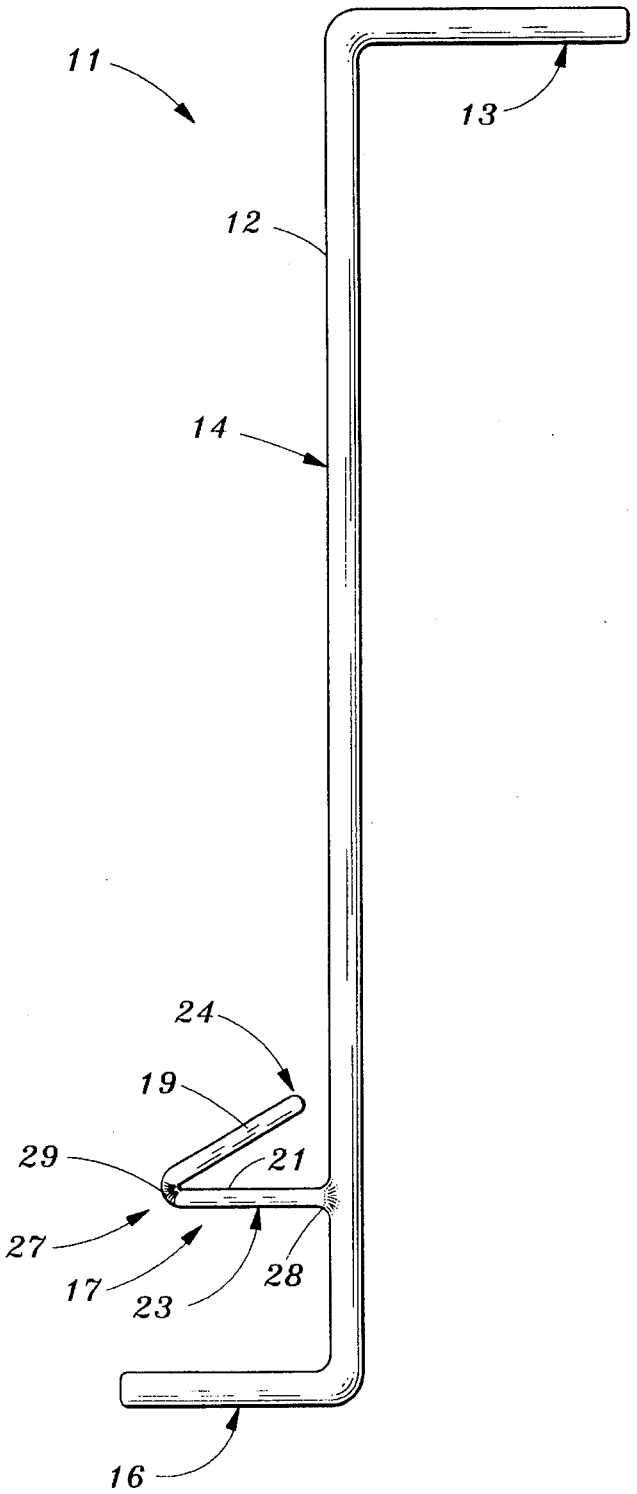
FIG. 2 is a side view of the boot puller of the preceding figure.

Referring jointly to FIGS. 1, 2 and 3, a boot puller 11 device embodying the invention has an elongated shaft 12 with an upper end 13 adapted to be comfortably grasped by a user of the device. Preferably the upper end 13 extends at right angles to the intermediate region 14 of the shaft in order to form a handle. The shaft 12 of this example is formed from a rod of circular cross section but the shaft may also have a rectangular cross section.

The lower end 16 of shaft 13 also extends at right angles to the intermediate region 14 and, in the preferred form of the invention, extends in a direction opposite to the direction in which the upper end 13 extends.

A pair of boot contacting arms 17 extend outward from the intermediate region 14 of shaft 12 at a location which is spaced above lower end 16. The arms are divergent and curve towards each other to provide a configuation which causes the arms to extend along opposite sides of the back portion of a boot 18 in contact therewith when the boot is seated against the arms 17 as shown in FIG. 4. The back of a boot 18 has a somewhat convex profile in the heel region and the arms 17 are shaped and positioned to wrap around the upper part of the convexity in contact therewith.

Referring again to FIGS. 1, 2 and 3, the arms 17 are preferably formed by upper and lower arm members 19 and 21 respectively. Lower arm member 21 has a central region 22 which is secured to shaft 12 at a location that is above and spaced apart from the lower end 16 of the shaft and has curved end portions 23 which extend outward from the shaft in a horizontal orientation to form the lower edge of the arms 17. The upper arm member 19 has a central region 24 which is spaced apart from the shaft 12 to accommodate to the convexity of the back of a boot and has curved end portions 26 which slant down to the ends 27 of the lower arm member 21 and which are joined to the lower arm member ends.

The boot puller 11 of this example is formed of metal and the joining of the lower arm member 21 to shaft 12 and the joining of the ends of the upper and lower members 19 and 21 is effected by welds 28 and 29 respectively. Other types of fastenings may be used for the purpose and boot puller may be formed of other materials such as plastic for example.

Referring again to FIG. 4, a person using the boot puller 11 to take off a boot grasps the handle 12 with one hand and abuts the lower end 16 of shaft 12 against the ground 31 or against pavement or a floor depending on the location of the person. The boot puller 11 is maintained stationary during the boot removal operation by pressing it towards the ground such as by leaning on handle 12. The back of the boot 18 is then seated against arms 17 in the manner previously described. Provided that any shoe string that may be present has been untied, the boot 18 is removed from the foot by simply pressing the foot against arms 17 while raising the foot.

It should be noted that prior hand held boot removing devices which have arms or prongs that clasp the back of the boot are actively manipulated during use and are used to push a boot off of one's foot. This is best accomplished while the person is in a seated position. The boot puller 11 of the present invention is stationary and passive during use and acts to pull the boot off of the foot of a standing person while also assisting the person in maintaining balance. Extension of the shaft 12 below the zone of contact of the arms 17 with the boot 18 enables this different mode of operation by enabling abutment of the device against the ground or other underlying surface.

The boot puller 11 is advantageous to a wearer of boots in still other ways. For example, the right angled bottom end 16 of the boot puller 11 or the angled handle 13 may be inserted into the removed boot and be used as a hook for lifting and carrying a muddy boot without requiring hand contact with the boot. The puller 11 may also be used to hold a boot in an upright orientation while a foot is being inserted into the boot by a standing person.

While the invention has been described with reference to a single preferred embodiment for purposes of example, many variations of the construction are possible and it is not intended to limit the invention except as defined by the following claims.

We claim:

1. A device for facilitating removal of a boot from a human foot which device has an elongated shaft with upper and lower ends, the upper end being adapted to be grasped by a person's hand, said device further having a pair of boot abutting arms which extend outward from said shaft for abutment with a rear portion of a boot at a location thereon that is above the bottom of the boot, the arms being shaped to extend along opposite sides of the rear portion of the boot, wherein the improvement comprises:

each of said arms being formed by a lower arm member and an upper arm member at least portions of which are spaced apart, the lower arms being convergent in the rearward direction towards said shaft and the upper arms also being convergent in the rearward direction towards said shaft, said arms being configured to abut the boot at a first location that is above the lower end of said shaft and spaced apart therefrom and wherein said shaft extends below that first location for a distance sufficient to enable contact of said lower end with the underlying ground at a second location while said arms abut the boot at said first location, said second location being spaced apart from said first location and being below said first location when said shaft is in an upward extending orientation.

2. The device of claim 1 wherein said lower end of said shaft is angled to extend horizontally along the underlying ground at said second location when said arms are in contact with the rear portion of the boot at said first location.

3. The device of claim 1 wherein said lower end of said shaft is angled and directed to extend horizontally under the rear portion of the boot at said second location when said arms are in contact therewith at said first location.

4. The device of claim 1 wherein said upper end of said shaft is angled to extend substantially horizontally when said arms are in contact with the rear portion of the boot and wherein said angled upper end of said shaft is directed away from the region above said arms.

5. The device of claim 1 wherein said upper member at each of said arms has a forward end which is joined to the lower member at a location which is spaced apart from said shaft and extends in the direction of said shaft in an upwardly angled relationship with said lower member.

6. The device of claim 1 wherein said lower arm members converge at a first central region at which said lower arm members are joined to said shaft and have first curved end portions which extend away from said first central region in diverging relationship with each other, and wherein said upper arm members converge at a second central region which is above said first central region in spaced apart relationship therewith, said upper arm members having second curved end portions which extend away from said second central region in diverging relationship with each other and wherein said second curved end portions extend downward from said second central region and have ends which are joined to ends of said first curved end portions of said lower arm members.

7. The device of claim 6 wherein said second central region is spaced apart from said shaft.

8. The device of claim 1 wherein said shaft has an intermediate region situated between said upper and lower ends thereof and at which said arms are secured to said shaft and wherein said lower end of said shaft is in a substantially right angled relationship with said intermediate region thereof and extends below said arms and is equidistant from each thereof.

9. The device of claim 8 wherein said upper end of said shaft is in a substantially right angled relationship with said intermediate region thereof and extends outward therefrom in a direction which is opposite from the direction at which said lower end extends outward from said shaft.

10. The device of claim 9 wherein said arms are located to contact the rear portion of the boot when the rear portion of the boot is resting on said angled lower end of said shaft.

11. A device for facilitating removal of a boot from a human foot comprising:

an elongated shaft having an intermediate region and an upper end which extends substantially at right angles thereto and having a lower end which extends in an opposite direction in right angled relationship with the intermediate region, and a lower pair of curved divergent arm members which extend outward from said intermediate region of said shaft at a location which is above said angled lower end of said shaft and spaced apart therefrom, said lower arm members being located to extend along opposite sides of a rear portion of a boot in position to be abutted against the boot when the angled lower end of the shaft is situated beneath the rear portion of the boot, and an upper pair of curved divergent arm members connected to the lower members and which extend outward from an area adjacent said intermediate region of said shaft at another location which is above said angled lower end of said shaft and spaced apart therefrom, said upper arm members also being located to extend along opposite sides of a rear portion of a boot in position to be abutted against a boot when the angled lower end of the shaft is situated beneath the rear portion of the boot.

* * * * *